US012780496B2

(12) United States Patent
Hodges

(10) Patent No.: US 12,780,496 B2
(45) Date of Patent: Nov. 3, 2026

(54) COLLATION OF PACKAGES

(71) Applicant: NICOVENTURES TRADING LIMITED, London (GB)

(72) Inventor: Paul Hodges, London (GB)

(73) Assignee: NICOVENTURES TRADING LIMITED, London (GB)

( * ) Notice: Subject to any disclaimer, the term of this patent is extended or adjusted under 35 U.S.C. 154(b) by 0 days.

(21) Appl. No.: 18/718,563

(22) PCT Filed: Dec. 12, 2022

(86) PCT No.: PCT/GB2022/053171
§ 371 (c)(1),
(2) Date: Jun. 11, 2024

(87) PCT Pub. No.: WO2023/111528
PCT Pub. Date: Jun. 22, 2023

(65) Prior Publication Data

US 2025/0042610 A1 Feb. 6, 2025

(30) Foreign Application Priority Data

Dec. 14, 2021 (GB) ..... 2118070

(51) Int. Cl.
*B65D 21/02* (2006.01)
*B65B 17/02* (2006.01)
(Continued)

(52) U.S. Cl.
CPC ..... *B65D 21/0205* (2013.01); *B65B 17/02* (2013.01); *B65B 19/00* (2013.01); *B65D 5/4275* (2013.01); *B65D 85/08* (2013.01)

(58) Field of Classification Search
CPC ..... B65D 21/0205; B65D 21/0208; B65D 85/10; B65D 85/08; B65D 21/0227; B65D 5/4275; B65D 85/1072
(Continued)

(56) References Cited

U.S. PATENT DOCUMENTS 5,115,916 A * 5/1992 Beasley ..... B65D 21/0205 206/581
5,931,292 A 8/1999 Focke et al.
(Continued)

FOREIGN PATENT DOCUMENTS

CA 2131765 A1 * 3/1996 ..... B65D 71/06
GB 2261648 * 5/1993
GB 2261648 A 5/1993
WO WO-2022096456 A1 * 5/2022 ..... B65B 61/08

OTHER PUBLICATIONS

PCT International Search Report and Written Opinion in International Appln. No. PCT/GB2022/053171, dated Feb. 28, 2023 13 pages.

*Primary Examiner* — Rafael A Ortiz
(74) *Attorney, Agent, or Firm* — MERCHANT & GOULD P.C.

(57) ABSTRACT

A collation of packages wherein each package is cuboid-shaped and includes a pair of opposing first faces, a pair of opposing second faces and a pair of opposing end faces. The packages are arranged in rows such that a second face of a package faces a second face of an adjacent package within the same row, and a first face of a package in a row faces a first face of a package in an adjacent row. A second face of a package at the ends of each row is exposed. At least one of the facing first faces, and at least one of the facing second faces, respectively, are adhered to each other using releasable adhesive such that the packages are held together in the
(Continued)

collation. The releasable adhesive includes at least one strip-shaped region of releasable adhesive.

23 Claims, 5 Drawing Sheets

(51) Int. Cl.
*B65B 19/00* (2006.01)
*B65D 5/42* (2006.01)
*B65D 85/08* (2006.01)

(58) Field of Classification Search
USPC ..... 206/271; 220/23.83
See application file for complete search history.

(56) References Cited

U.S. PATENT DOCUMENTS

| | | | | |
|---|---|---|---|---|
| 6,557,699 | B1 | 5/2003 | Focke et al. | |
| 6,666,332 | B1 * | 12/2003 | DeWolf | B65D 5/422 206/45.28 |
| 2011/0147388 | A1 * | 6/2011 | Thomann | B65D 5/4275 156/291 |
| 2011/0284534 | A1 * | 11/2011 | Frizell | B65B 61/02 53/448 |
| 2016/0001924 | A1 * | 1/2016 | Liu | B65D 23/00 220/23.4 |
| 2018/0009557 | A1 * | 1/2018 | Fischer | B65B 17/025 |

* cited by examiner

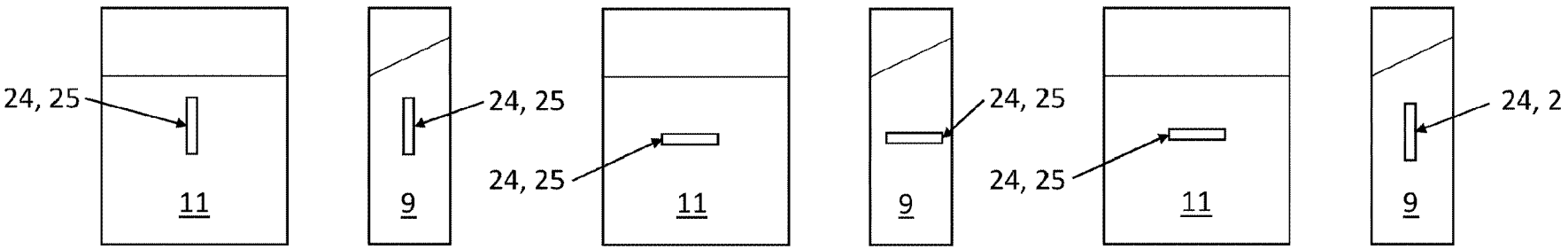
Figure 3A
Figure 3B
Figure 3C
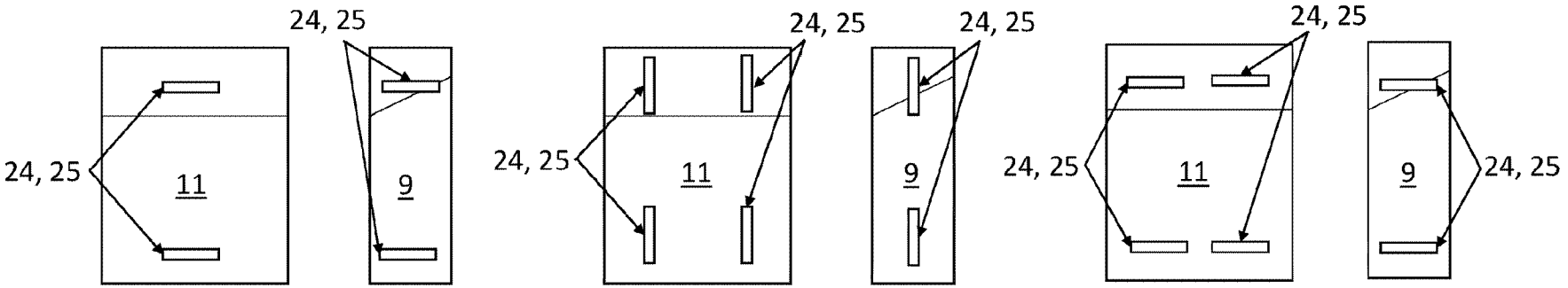
Figure 3D
Figure 3E
Figure 3F

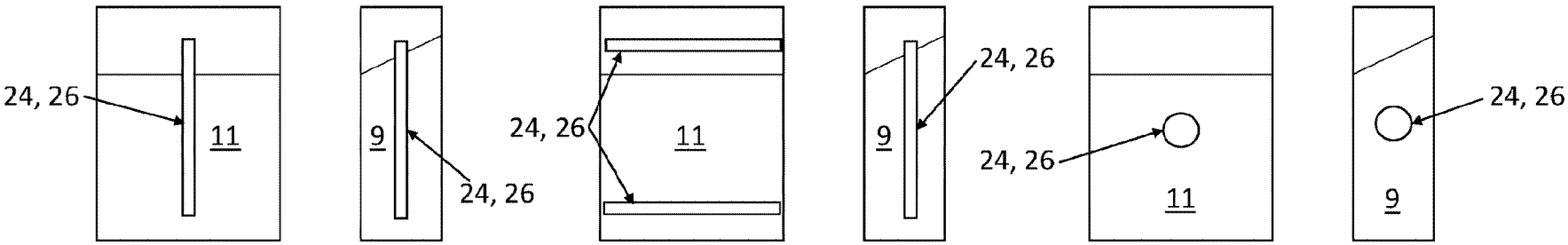
Figure 3G
Figure 3H
Figure 3I
Figure 3J
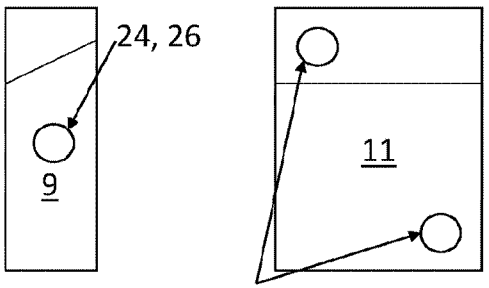
Figure 3K
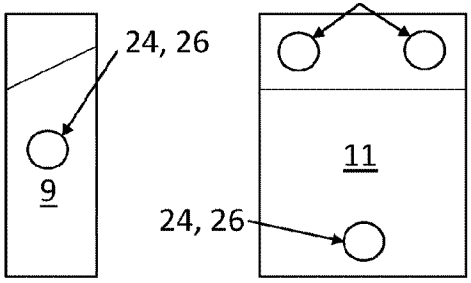
Figure 3L

COLLATION OF PACKAGES

RELATED APPLICATIONS

The present application is a National Phase entry of PCT Application No. PCT/GB2022/053171 filed Dec. 12, 2022, which claims priority to GB Application No. 2118070.8 filed Dec. 14, 2021, each of which is hereby incorporated by reference in their entirety.

TECHNICAL FIELD

The present invention relates to a collation of packages. A method of retaining packages together in a collation is also disclosed.

BACKGROUND

Known delivery systems, such as combustible and non-combustible aerosol provision systems and other tobacco industry products, are usually contained in packages. Often multiple packages are collated and placed in cartons. The cartons may be formed from cardboard or a similar material. Alternatively, the plurality of packages may be wrapped in plastic. The cartons and/or wrapping is opened to access individual packages.

SUMMARY

According to an aspect of the present invention, there is provided a collation of packages, each package of the collation being cuboid-shaped and comprising a pair of opposing first faces, a pair of opposing second faces and a pair of opposing end faces; wherein the packages are arranged in rows such that a second face of a package faces a second face of an adjacent package within the same row, and a first face of a package in a row faces a first face of a package in an adjacent row, a second face of a package at the ends of each row being exposed; wherein at least one of the facing first faces, and at least one of the facing second faces, respectively, are adhered to each other using releasable adhesive such that the packages are held together in the collation; and wherein the releasable adhesive comprises at least one strip-shaped region of releasable adhesive.

Optionally, each of the facing first faces may be adhered to each other using releasable adhesive comprising at least one strip-shaped region of releasable adhesive.

The collation may comprise a plurality of strip-shaped regions of releasable adhesive adhering each of the facing first faces to each other.

At least one strip-shaped region may extend at an angle to at least one other strip-shaped region.

Optionally, each of the facing second faces may be adhered to each other using releasable adhesive comprising at least one strip-shaped region of releasable adhesive.

The collation may comprise a plurality of strip-shaped regions of releasable adhesive adhering each of the facing second faces to each other.

At least one strip-shaped region may extend at an angle to at least one other strip-shaped region.

The strip-shaped region may be linear.

At least one strip-shaped region may extend in a direction perpendicular to a top plane defined by one end face of each package in the collation.

At least one strip-shaped region may extend in a direction parallel to a top plane defined by one end face of each package in the collation.

At least one strip-shaped region may extend in a direction at an angle to a top plane defined by one end face of each package in the collation.

The releasable adhesive may comprise spot-shaped regions of releasable adhesive in addition to said strip-shaped regions.

Optionally, at least one of the facing first faces may be adhered to each other via releasable adhesive comprising a spot-shaped region.

At least one of the facing second faces may be adhered to each other via releasable adhesive comprising a spot-shaped region.

Said releasable adhesive may be transparent.

Said releasable adhesive may comprise cool-melt or hot-melt adhesive.

According to another aspect of the present invention, there is provided a collation of packages, each package of the collation being cuboid-shaped and comprising a pair of opposing first faces, a pair of opposing second faces and a pair of opposing end faces; wherein the packages are arranged in rows such that a second face of a package faces a second face of an adjacent package within the same row, and a first face of a package in a row faces a first face of a package in an adjacent row, a second face of a package at the ends of each row being exposed; wherein at least one of the facing first faces, and at least one of the facing second faces, respectively, are adhered to each other using releasable adhesive such that the packages are held together in the collation; and wherein for at least one of the facing first faces attached via the releasable adhesive, the releasable adhesive comprises at least three regions of releasable adhesive.

Optionally, each of the facing first faces may be adhered to each other with at least three regions of releasable adhesive.

At least one of the three regions of releasable adhesive may be spot-shaped.

At least one of the three regions of releasable adhesive may be strip-shaped.

Optionally, at least one of the facing second faces may be adhered to each other with at least three regions of releasable adhesive.

At least one of the three regions of releasable adhesive may be spot-shaped.

At least one of the three regions of releasable adhesive may be strip-shaped.

At least one strip-shaped region may be linear.

At least one strip-shaped region may extend in a direction perpendicular to a top plane defined by one end face of each package in the collation.

At least one strip-shaped region may extend in a direction parallel to a top plane defined by one end face of each package in the collation.

At least one strip-shaped region may extend in a direction at an angle to a top plane defined by one end face of each package in the collation.

Said releasable adhesive may be transparent.

Said releasable adhesive may comprise cool-melt or hot-melt adhesive.

According to another aspect of the present invention, there is provided a collation of packages, each package of the collation being cuboid-shaped and comprising a pair of opposing first faces, a pair of opposing second faces and a pair of opposing end faces; wherein the packages are arranged in rows such that a second face of a package faces a second face of an adjacent package within the same row, and a first face of a package in a row faces a first face of a package in an adjacent row, a second face of a package at the ends of each row being exposed; wherein at least one of the facing first faces, and at least one of the facing second faces, respectively, are adhered to each other using releasable adhesive such that the packages are held together in the collation; and wherein the releasable adhesive is transparent.

According to another aspect of the present invention, there is provided a method of retaining packages together in a collation, the method comprising: providing a plurality of cuboid-shaped packages, each package comprising a pair of opposing first faces, a pair of opposing second faces and a pair of opposing end faces; arranging the packages in rows such that a second face of a package faces a second face of an adjacent package within the same row, and a first face of a package in a row faces a first face of a package in an adjacent row, a second face of a package at the ends of each row being exposed; adhering at least one of the facing first faces, and at least one of the facing second faces to each other using strip-shaped regions of releasable adhesive such that the packages are held together in a collation.

According to another aspect of the present invention, there is provided a method of retaining packages together in a collation, the method comprising: providing a plurality of cuboid-shaped packages, each package comprising a pair of opposing first faces, a pair of opposing second faces and a pair of opposing end faces; arranging the packages in rows such that a second face of a package faces a second face of an adjacent package within the same row, and a first face of a package in a row faces a first face of a package in an adjacent row, a second face of a package at the ends of each row being exposed; adhering at least one of the facing first faces, and at least one of the facing second faces to each other using regions of releasable adhesive such that the packages are held together in a collation; and wherein for at least one of the facing first faces attached via the releasable adhesive, the releasable adhesive comprises at least three adhesive regions.

According to another aspect of the present invention, there is provided a method of retaining packages together in a collation, the method comprising: providing a plurality of cuboid-shaped packages, each package comprising a pair of opposing first faces, a pair of opposing second faces and a pair of opposing end faces; arranging the packages in rows such that a second face of a package faces a second face of an adjacent package within the same row, and a first face of a package in a row faces a first face of a package in an adjacent row, a second face of a package at the ends of each row being exposed; adhering at least one of the facing first faces, and at least one of the facing second faces to each other using a transparent releasable adhesive such that the packages are held together in a collation.

BRIEF DESCRIPTION OF THE DRAWINGS

So that the invention may be more fully understood, embodiments of the present invention will now be described, by way of example only, with reference to accompanying drawings, in which:

FIGS. 3A to 3L show regions of releasable adhesive applied to a package of a collation of packages.

DETAILED DESCRIPTION

As used herein the term "delivery system" is intended to encompass systems that deliver a substance to a user, and includes:

- combustible aerosol provision systems, such as cigarettes, cigarillos, cigars, and tobacco pipes or for roll-your-own cigarettes (whether based on tobacco, tobacco derivatives, expanded tobacco, reconstituted tobacco, tobacco substitutes or other smokeable material);
- non-combustible aerosol provision systems that release compounds from an aerosolizable material without combusting the aerosolizable material, such as electronic cigarettes, tobacco heating products, and hybrid systems to generate aerosol using a combination of aerosolizable materials;
- articles comprising aerosolizable material and configured to be used within one of these non-combustible aerosol provision systems; and
- aerosol-free delivery systems, such as lozenges, gums, patches, articles comprising inhalable powders, and smokeless tobacco products such as snus and snuff, which deliver a material to a user without forming an aerosol, wherein the material may or may not comprise nicotine.

According to the present disclosure, a "combustible" aerosol provision system is one where a constituent aerosoliable material of the aerosol provision system (or component thereof) is combusted or burned in order to facilitate delivery to a user.

According to the present disclose, a "non-combustible" aerosol provision system is one where a constituent aerosolizable material of the aerosol provision system (or component thereof) is not combusted or burned in order to facilitate delivery to a user.

Figure 1:
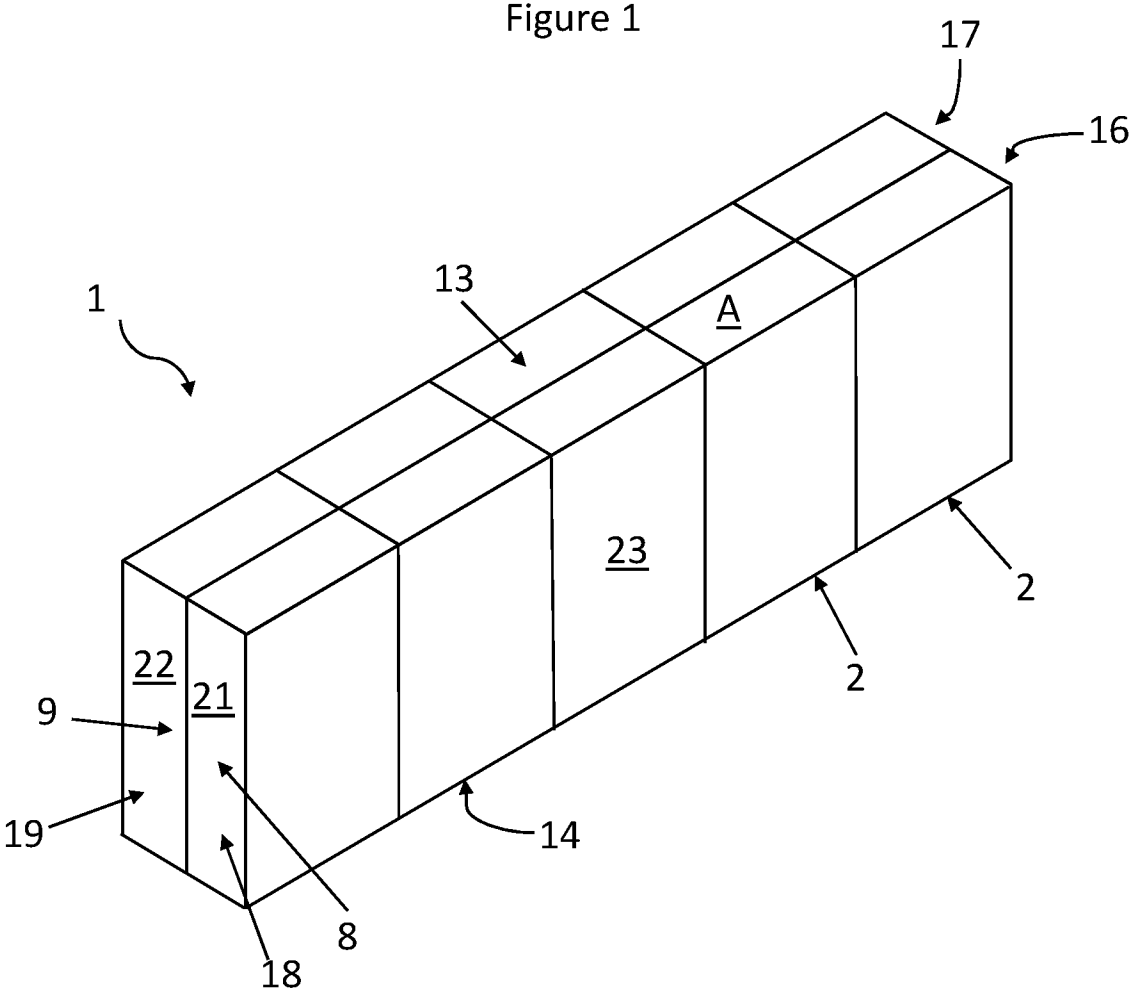
FIG. 1 shows a collation of packages for delivery systems.

Referring to FIG. 1, there is shown a collation 1 of packages 2 for delivery systems (not shown). The collation 1 of packages 2 comprises a plurality of individual cuboid-shaped packages 2. An exemplary individual package 2 for delivery systems is shown in FIG. 2.

Figure 2:
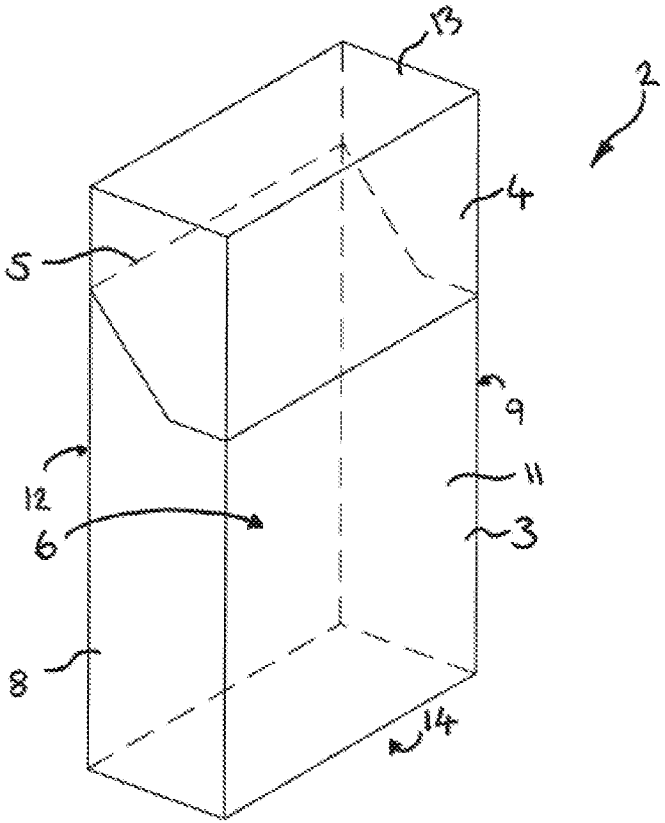
FIG. 2 shows an individual package of a collation of packages.

Referring briefly to FIG. 2, the package 2 may be, for example, but not limited to, a hinge lid pack, as illustrated. The package 2 comprises a container 3 and a lid 4 hingedly connected to the container 3 along a hinge line 5 in order to allow the package to be opened and closed. It will be appreciated that the container 3 forms a delivery system receiving space 6 in which delivery systems such as smoking articles or other tobacco industry products are received and stored. The delivery systems are accessible when the lid 4 is in an open position, and the delivery systems are retained in the delivery system receiving space 6 when the lid 4 is in a closed position. Other types of package, such as those known as clamshell or slide and shell, are also within the scope of the invention.

The package 2 comprises a pair of opposing first faces 11, 12, a pair of opposing second faces 8, 9, and a pair of opposing end faces 13, 14. The pair of opposing first faces 11, 12 are separated by opposing second faces 8, 9. In the present embodiment, the opposing first faces 11, 12 form major panels 11, 12 which make up the front and rear panels of the package 2. The front first face or major panel 11 may comprise a front container wall and a front lid wall. The rear first face or major panel 12 may comprise a rear container wall and a rear lid wall. In the present embodiment, the opposing second faces 8, 9 form minor walls 8, 9 which make up the side walls of the package 2. The second faces or side walls 8, 9 of the package 2 may comprise container side walls and lid side walls. The ends of the package 2 are closed by opposing end faces 13, 14 comprising a top end face 13 and a bottom end face 14. In the present embodiment, the top end face 13 may comprise a lid top wall and the bottom end face 14 may comprise a container bottom wall.

Referring now back to FIG. 1, it can be seen that the plurality of individual packages 2 for delivery systems which make up the collation 1 of packages 2 are arranged into rows. In the embodiment shown in FIG. 1, the collation 1 of packages 2 comprises a first row 16 and a second row 17. The first and second rows 16, 17 are adjacent one another.

In the present embodiment, the packages 2 are arranged into rows 16, 17 such that a second face 8, 9 of a package 2 faces a second face 8, 9 of an adjacent package 2 within the same row 16, 17. Furthermore, the packages 2 are arranged such that a first face 11, 12 of a package 2 in a row 16 faces a first face 11, 12 of a package 2 in an adjacent row 17. In addition, the packages 2 are arranged such that a second face 8, 9 of a package 2 at an end 18, 19 of each row 16, 17 and a first face 11, 12 of each package 2 along the rows 16, 17 are exposed. Furthermore, the end faces 13 of the packages 2 in the collation 1 define a top plane A.

However, it will be appreciated that in alternative embodiments, the packages 2 may be arranged such that a first face 11, 12 of a package 2 faces a first face 11, 12 of an adjacent package 2 within the same row 16, 17 or such that an end face 13, 14 of adjacent packages 2 within the same row 16, 17 face each other.

In the present embodiment, the collation 1 comprises two rows of five packages 2. However, it will be understood that in an alternative embodiment, the number of packages in a row may be different and the number of rows present may be greater.

Each row 16, 17 has two ends 18, 19, as mentioned above. Each end 18, 19 of the rows 16, 17 comprise a free surface 21, 22. The free surface 21, 22 is formed by a second face 8, 9 of an individual package 2 which is located at the end 18, 19 of a row 16, 17. Therefore, the free surface 21, 22 formed by a second face 8, 9 of the package 2 at the end 18, 19 of the row 16, 17 does not face towards an adjacent package in the same row 16, 17. For example, in the present embodiment, the first row 16 of packages has an end 18 formed by the free surface 21 which is a second face 8 of the individual package 2 at the end 18 of the first row 16, and the second row 17 of packages has an end 19 formed by the free surface 22 which is a second face 9 of the individual package 2 at the end 19 of the second row 17.

In the present embodiment, each package 2 within each row 16, 17 has an exposed first face 11, 12 which forms a free surface 23. The free surface 23 formed by a first face 11, 12 of a package 2 does not face towards a package 2 in an adjacent row.

The packages 2 are retained within the collation 1 via releasable adhesive 24. In particular, at least one of the facing first faces 11, 12 and at least one of the facing second faces 8, 9, respectively, are adhered to one another using releasable adhesive 24 such that the packages 2 are held together in the collation 1. It is to be appreciated that any number of the facing first faces 11, 12 and facing second faces 8, 9, respectively, may be adhered to one another as long as a sufficient number of packages 2 are adhered to each other such that the packages 2 are retained within the collation 1. For example, each of the facing first faces 11, 12 may be adhered to each other via releasable adhesive 24. Additionally, each of the facing second faces 8, 9 may be adhered to each other via releasable adhesive 24.

According to a first embodiment of the invention, the releasable adhesive 24 comprises at least one strip-shaped region 25 of releasable adhesive. Optionally, each of the facing first faces 11, 12 are adhered to each other via releasable adhesive 24 comprising at least one strip-shaped region 25 as seen in FIGS. 3A to 3C. Alternatively, each of the facing first faces 11, 12 are adhered to each other via releasable adhesive 24 comprising a plurality of strip-shaped regions 25, as seen in FIGS. 3D to 3F. It is to be appreciated that the facing first faces 11, 12 may be adhered to one another with a combination of at least one strip-shaped region 25 and a plurality of strip-shaped regions 25 of releasable adhesive 24. The plurality of strip-shaped regions 25 illustrated in FIGS. 3D to 3F all extend in the same direction. Alternatively, at least one strip-shaped region 25 extends at an angle to at least one other strip-shaped region 25. The above is also applicable to each of the facing second faces 8, 9. The use of a plurality of strip-shaped regions may provide a more stable collation since the load acting on each package can be better distributed.

As seen in FIGS. 3A to 3H, the strip-shaped region 25 is linear, however, it is to be appreciated that the strip-shaped region 25 may also be non-linear, for example the strip-shaped region 25 may be curved or helical. In FIGS. 3A, 3E and 3G, the strip-shaped region 25 extends in a direction perpendicular to the top plane A formed by the end faces 13 of the packages 2 in the collation 1. Alternatively, in FIGS. 3B, 3D and 3F, the strip-shaped region 25 extends in a direction parallel to the top plane A. In some embodiments, the strip-shaped region 25 extends in a direction at an angle to the top plane A. As seen in FIG. 3G, the strip-shaped region 25 located on the first face 11 extends such that it covers a portion of the front container wall and front lid wall. It is to be appreciated that if located on the first face 12, the strip-shaped region 25 may extend such that it covers a portion of the rear container wall and rear lid wall. Additionally, the strip-shaped region 25 located on the facing second faces 8, 9 extends such that it covers a portion of the container side wall and lid side wall.

Using strip-shaped regions of adhesive compared to other shapes may enable a consumer to easily remove the adhesive from the package since a strip-shaped region of adhesive may provide easy peeling of the adhesive. Additionally, strip-shaped regions of adhesive may allow a more stable adhesion of the packages in the collation. Furthermore, the use of strip-shaped regions may reduce the wear on the adhesive application nozzle of a glue gun since the nozzle is open for a relatively long time. This also mitigates the need to regularly clean the nozzle since it is less likely to become jammed.

In some embodiments, the releasable adhesive 24 comprises spot-shaped regions 26 of releasable adhesive in addition to the strip-shaped regions 25 as seen in FIGS. 31 to 3L. For example, at least one of the facing first faces 11, 12 or one of the facing second faces 8, 9 are adhered to each other via releasable adhesive 24 comprising a spot-shaped region 26. Alternatively, each of the regions of the facing first faces 11, 12 or each of the facing second faces 8, 9 are adhered to each other via releasable adhesive 24 comprising a spot-shaped region 26. The spot-shaped region 26 may be hollow, i.e. a ring of adhesive, or a solid dot of adhesive. Packages adhered to one another by spot-shaped regions may be more easily separated in use. Furthermore, at least some of the facing first faces 11, 12 or facing second faces 8, 9 are adhered to one another via releasable adhesive 24 comprising a plurality of spot-shaped regions 26, as illustrated in FIGS. 3J to 3L. On the other hand, each of the facing first faces 11, 12 or each of the facing second faces 8, 9 may be adhered to one another via releasable adhesive 24 comprising a plurality of spot-shaped regions 26. The use of a plurality of spot-shaped regions allows thinner spots of adhesive to be applied to the package, rather than a single thicker spot of adhesive, whilst maintaining the structural integrity of the collation. This enables improved transparency and heat transfer (where the adhesive requires curing via heat) of the adhesive since the adhesive applied is relatively thin. Additionally, a plurality of spot-shaped regions may provide a more stable collation with spread load points.

It is to be appreciated that the releasable adhesive 24 between the facing first faces 11, 12 and between the facing second faces 8, 9 may comprise any combination of strip-shaped regions, plurality of strip-shaped regions, spot-shaped regions or plurality of spot-shaped regions in any orientation as long as enough of the facing first faces 11, 12 and enough of the facing second faces 8, 9 are adhered to one another such that the packages 2 are retained in the collation and that the releasable adhesive 24 comprises at least one strip-shaped region 25.

The releasable adhesive 24 comprises transparent adhesive. This ensures that information displayed on the packages 2 is not obscured from the view of a consumer by the releasable adhesive 24. Additionally, the releasable adhesive 24 comprises hot-melt adhesive. Alternatively, the releasable adhesive 24 comprises cool-melt adhesive. In particular, the adhesive 24 may be gummy glue, also known as fugitive glue, which is a low temperature thermoplastic adhesive and which does not fully cure. This adhesive is removable and leaves no residue on the surface to which the adhesive is applied. Use of this adhesive allows a user to remove the packages in the collation easily without risk of damaging the package surface. Once removed from the collation, the adhesive can be easily removed from the surface of the package for disposal.

According to a second embodiment of the invention, for at least one of the facing first faces 11, 12 attached via the releasable adhesive 24, the releasable adhesive 24 comprises at least three regions of releasable adhesive. It is to be appreciated that optionally each of the facing first faces 11, 12 may be adhered to each other via releasable adhesive 24 comprising at least three adhesive features. Optionally, each of the facing second faces 8, 9 are also adhered to each other via releasable adhesive 24 comprising at least three adhesive regions.

The at least three adhesive regions include the strip-shaped regions 25 and spot-shaped regions 26 as described above in relation to the first embodiment. It is to be appreciated that any arrangement of adhesive regions is possible as long as the releasable adhesive 24 attaching at least one of the facing first faces 11, 12 together comprises at least three adhesive regions. FIG. 3L illustrates the releasable adhesive 24 between at least one facing first faces 11, 12 of the packages 2 comprising three adhesive regions. Here, all three adhesive regions are spot-shaped regions 26. However, it is to be appreciated that at least one of the at least three adhesive regions may comprise a strip-shaped regions 25, or each of the at least three adhesive regions comprise a strip-shaped region 25.

As in the first embodiment, the releasable adhesive 24 of the second embodiment is transparent and either hot-melt or cool-melt adhesive.

According to a third embodiment of the invention, any combination/orientation of releasable adhesive described above is possible as long as the releasable adhesive is transparent.

Figure 4:
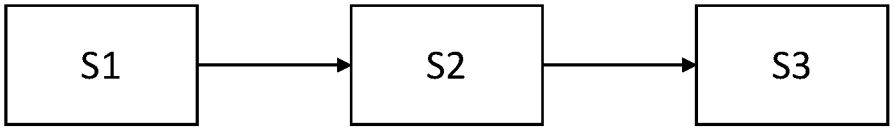
FIG. 4 shows a method of retaining packages together in a collation.

FIG. 4 illustrates a method of retaining packages together in a collation according to each embodiment of the invention. The method comprises a first step S1 of providing a collation of cuboid-shaped packages, each package comprising a pair of opposing first faces, a pair of opposing second faces and a pair of opposing end faces. The second step S2 involves arranging the packages in rows such that a second face of a package faces a second face of an adjacent package within the same row, and a first face of a package in a row faces a first face of a package in an adjacent row, a second face of a package at the end of each row, and a first face of a package in a row being exposed. The third step S3 is different in relation to each embodiment of the invention. According to a first embodiment of the invention, the method comprises a third step S3 including adhering at least one of the facing first faces, and at least one of the facing second faces to each other using strip-shaped regions of releasable adhesive such that the packages are held together in a collation. In relation to the second embodiment of the invention, the method comprises a third step S3 of adhering at least one of the facing first faces, and at least one of the facing second faces to each other using regions of releasable adhesive such that the packages are held together in a collation, and for at least one of the facing first faces attached via the releasable adhesive, the releasable adhesive comprises at least three adhesive regions. In relation to the third embodiment of the invention, the method comprises a third step S3 of adhering at least one of the facing first faces, and at least one of the facing second faces to each other using transparent releasable adhesive such that the packages are held together in a collation.

The various embodiments described herein are presented only to assist in understanding and teaching the claimed features. These embodiments are provided as a representative sample of embodiments only, and are not exhaustive and/or exclusive. It is also to be understood that advantages, embodiments, examples, functions, features, structures, and/or other aspects described herein are not to be considered limitations on the scope of the invention as defined by the claims or limitations on equivalents to the claims, and that other embodiments may be utilized and modifications may be made without departing from the scope of the claimed invention. Various embodiments of the invention may suitably comprise, consist of, or consist essentially of, appropriate combinations of the disclosed elements, components, features, parts, steps, means, etc, other than those specifically described herein. In addition, this disclosure may include other inventions not presently claimed, but which may be claimed in future.

The invention claimed is:

1. A collation of packages, each package of the collation being cuboid-shaped and comprising a pair of opposing first faces, a pair of opposing second faces and a pair of opposing end faces;

wherein the packages are arranged in rows such that a second face of a package faces a second face of an adjacent package within the same row, and a first face of a package in a row faces a first face of a package in an adjacent row, a second face of a package at the ends of each row being exposed;

wherein at least one of the facing first faces, and at least one of the facing second faces, respectively, are adhered to each other using releasable adhesive such that the packages are held together in the collation;

wherein the releasable adhesive comprises at least one strip-shaped region of releasable adhesive and at least one spot-shaped region of releasable adhesive; and wherein at least one of the facing first faces are adhered to each other via releasable adhesive comprising a strip-shaped region and a spot-shaped region, such that an interface between the at least one of the facing first faces comprises both the strip-shaped region of releasable adhesive and the spot-shaped region of releasable adhesive.

2. A collation of packages according to claim 1, wherein each of the facing first faces are adhered to each other using releasable adhesive comprising at least one strip-shaped region of releasable adhesive.

3. A collation of packages according to claim 2, comprising a plurality of strip-shaped regions of releasable adhesive adhering each of the facing first faces to each other.

4. A collation of packages according to claim 3, wherein at least one strip-shaped region extends at an angle to at least one other strip-shaped region.

5. A collation of packages according to any of claim 1, wherein each of the facing second faces are adhered to each other using releasable adhesive comprising at least one strip-shaped region of releasable adhesive.

6. A collation of packages according to claim 5, comprising a plurality of strip-shaped regions of releasable adhesive adhering each of the facing second faces to each other.

7. A collation of packages according to claim 6, wherein at least one strip-shaped region extends at an angle to at least one other strip-shaped region.

8. A collation of packages according to claim 1, wherein at least one strip-shaped region extends in a direction perpendicular to a top plane defined by one end face of each package in the collation.

9. A collation of packages according to claim 1, wherein at least one strip-shaped region extends in a direction parallel to a top plane defined by one end face of each package in the collation.

10. A collation of packages according to claim 1, wherein at least one strip-shaped region extends in a direction at an angle to a top plane defined by one end face of each package in the collation.

11. A collation of packages according to claim 1, wherein said releasable adhesive is transparent.

12. A collation of packages according to claim 4, wherein the at least one strip-shaped region is not parallel to the at least one other strip-shaped region.

13. A collation of packages according to claim 10, wherein the at least one strip-shaped region is not parallel to the top plane defined by one end face of each package in the collation.

14. A collation of packages according to claim 1, wherein each package of the collation comprises a main body and a lid, and wherein the at least one strip-shaped region extends such that it covers portion of the main body and the lid.

15. A collation of packages according to claim 1, wherein the at least one strip-shaped region is curved or helical.

16. A collation of packages according to claim 1, wherein the at least one spot-shaped region is hollow.

17. A collation of packages, each package of the collation being cuboid-shaped and comprising a pair of opposing first faces, a pair of opposing second faces and a pair of opposing end faces;

wherein the packages are arranged in rows such that a second face of a package faces a second face of an adjacent package within the same row, and a first face of a package in a row faces a first face of a package in an adjacent row, a second face of a package at the ends of each row being exposed;

wherein at least one of the facing first faces, and at least one of the facing second faces, respectively, are adhered to each other using releasable adhesive such that the packages are held together in the collation; and wherein for at least one of the facing first faces attached via the releasable adhesive, the releasable adhesive comprises at least three regions of releasable adhesive;

wherein at least one of the three regions of releasable adhesive is spot-shaped; and wherein at least one of the three regions of releasable adhesive is strip-shaped;

such that an interface between the at least one of the facing first faces comprises both a strip-shaped region of releasable adhesive and a spot-shaped region of releasable adhesive.

18. A collation of packages according to claim 17, wherein each of the facing first faces are adhered to each other with at least three regions of releasable adhesive.

19. A collation of packages according to any of claim 17, wherein at least one of the facing second faces are adhered to each other with at least three regions of releasable adhesive.

20. A collation of packages according to claim 17, wherein at least one strip-shaped region extends in a direction perpendicular to a top plane defined by one end face of each package in the collation.

21. A collation of packages according to claim 17, wherein the at least one strip-shaped region extends in a direction parallel to a top plane defined by one end face of each package in the collation.

22. A collation of packages according to claim 17, wherein the at least one strip-shaped region extends in a direction parallel to a top plane defined by one end face of each package in the collation.

23. A collation of packages according to any of claim 17, wherein said releasable adhesive is transparent.

* * * * *